US011925272B2

(12) United States Patent
Davis et al.

(10) Patent No.: US 11,925,272 B2
(45) Date of Patent: Mar. 12, 2024

(54) FURNITURE AND ITEM COVERINGS AND METHODS OF MAKING SAME

(71) Applicants: Nathaniel Marshon Davis, North Brunswick, NJ (US); Laurine Joanne Rohl, North Brunswick, NJ (US)

(72) Inventors: Nathaniel Marshon Davis, North Brunswick, NJ (US); Laurine Joanne Rohl, North Brunswick, NJ (US)

( * ) Notice: Subject to any disclaimer, the term of this patent is extended or adjusted under 35 U.S.C. 154(b) by 305 days.

(21) Appl. No.: 17/478,890

(22) Filed: Sep. 18, 2021

(65) Prior Publication Data

US 2022/0095810 A1 Mar. 31, 2022

Related U.S. Application Data

(60) Provisional application No. 63/084,676, filed on Sep. 29, 2020.

(51) Int. Cl.
*A47C 31/10* (2006.01)

(52) U.S. Cl.
CPC ..... *A47C 31/10* (2013.01)

(58) Field of Classification Search
CPC ..... A45C 31/10
See application file for complete search history.

(56) References Cited

U.S. PATENT DOCUMENTS 738,674 A * 9/1903 Grattan ..... A47G 9/0246 297/228.11
1,836,302 A * 12/1931 Bloomfield ..... B60N 2/609 297/229
1,971,395 A * 8/1934 Danner ..... B65D 81/3897 383/110
2,454,463 A * 11/1948 Kromer ..... A47G 9/0246 5/497
2,757,389 A * 8/1956 King ..... A47G 9/0246 5/496
4,317,244 A * 3/1982 Balfour-Richie .... A47G 9/0246 5/500
5,549,355 A 8/1996 Illulian
5,582,115 A 12/1996 Muller
2003/0116460 A1* 6/2003 Berke ..... B65D 88/1612 206/386
2008/0067098 A1* 3/2008 Raine ..... B65D 65/02 206/524.2
2009/0045097 A1 2/2009 Moss et al.

OTHER PUBLICATIONS

Ebay Monster Trucks MT101112 Chair Cover.
MoversSupplies.Com Dining Chair Cover.
MoversSupplies.com Website.

* cited by examiner

*Primary Examiner* — Tri M Mai
(74) *Attorney, Agent, or Firm* — SLEMAN & LUND LLP

(57) ABSTRACT

A furniture covering includes a main body extending from a first end to a second end, the main body having a pair of first tabbed ends at the first end, and the pair of second tabbed ends at the second end, a pair of end portions coupled to a midsection of the main body, a pair of first wings coupled to the first tabbed ends, and a pair of second wings coupled to the second tabbed ends, the pair of first wings and the pair of second wings being set back from respective edges of the tabbed ends.

5 Claims, 4 Drawing Sheets

FIG. 2

FURNITURE AND ITEM COVERINGS AND METHODS OF MAKING SAME

CROSS-REFERENCE TO RELATED APPLICATIONS

This application claims priority to U.S. Provisional Ser. No. 63/084,676, filed Sep. 29, 2020, entitled "FURNITURE AND ITEM COVERINGS AND METHODS OF MAKING SAME," the content of which is hereby incorporated by reference in its entirety as if fully set forth herein.

FIELD OF THE DISCLOSURE

The present disclosure relates to devices and methods for covering furniture, appliance and the like. More specifically, the present invention relates to devices used to cover items to protect them during transportation.

BACKGROUND OF THE DISCLOSURE

Blankets are often used to cover furniture, appliances and other large items during transportation. Typically, the blankets are draped over the item, and heavy duty stretch wrap is used and wrapped around the draped item to keep the blankets in place. After transportation, the blankets are removed and the stretch wrap is discarded, where it eventually ends up in landfills. For this reason, the conventional devices and techniques pose a concern for the environment. Additionally, these devices and techniques are wasteful and uneconomical.

SUMMARY OF THE DISCLOSURE

In some embodiments, a furniture covering includes a quilted main body extending from a first end to a second end, the quilted main body having a pair of first tabbed ends at the first end, and the pair of second tabbed ends at the second end, a pair of end portions coupled to a midsection of the quilted main body, a pair of first wings coupled to the first tabbed ends, and a pair of second wings coupled to the second tabbed ends, the pair of first wings and the pair of second wings being set back from respective edges of the tabbed ends.

BRIEF DESCRIPTION OF THE DISCLOSURE

Various embodiments of the presently disclosed training devices are disclosed herein with reference to the drawings, wherein.

Various embodiments of the present invention will now be described with reference to the appended drawings. It is to be appreciated that these drawings depict only some embodiments of the disclosure and are therefore not to be considered limiting of its scope.

DETAILED DESCRIPTION

Despite the various improvements that have been made to furniture blankets, conventional devices and methods suffer from certain shortcomings such as those discussed above.

There therefore is a need for further improvements to the devices and methods used for protecting items during transport. Among other advantages, the present disclosure may address one or more of these needs.

Figure 1:
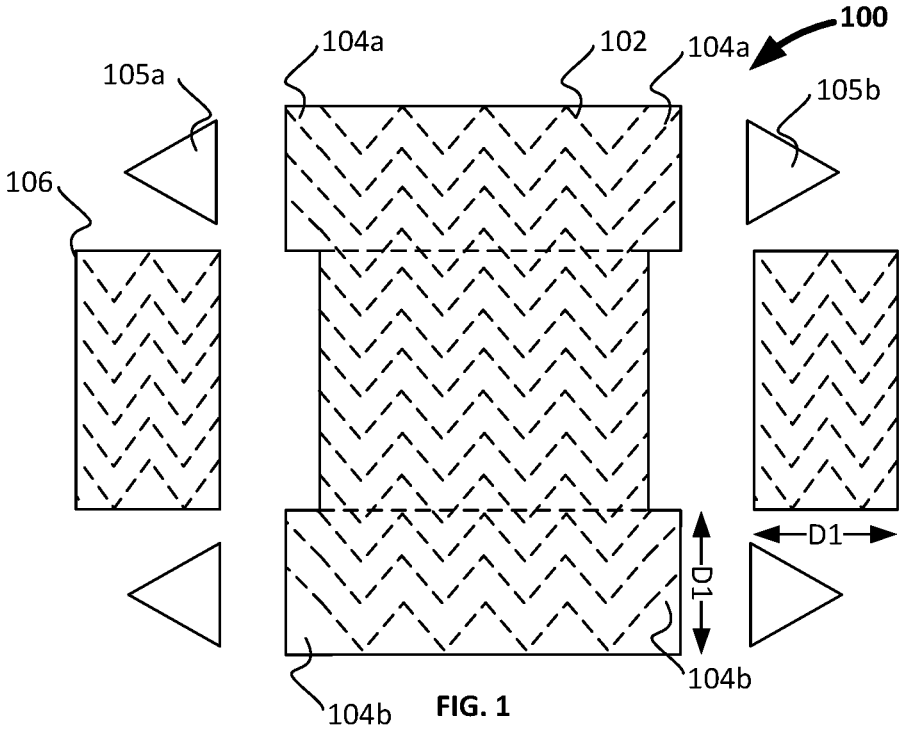
FIGS. 1-2 are schematic representations of an item covering according to one embodiment.
Figure 2:
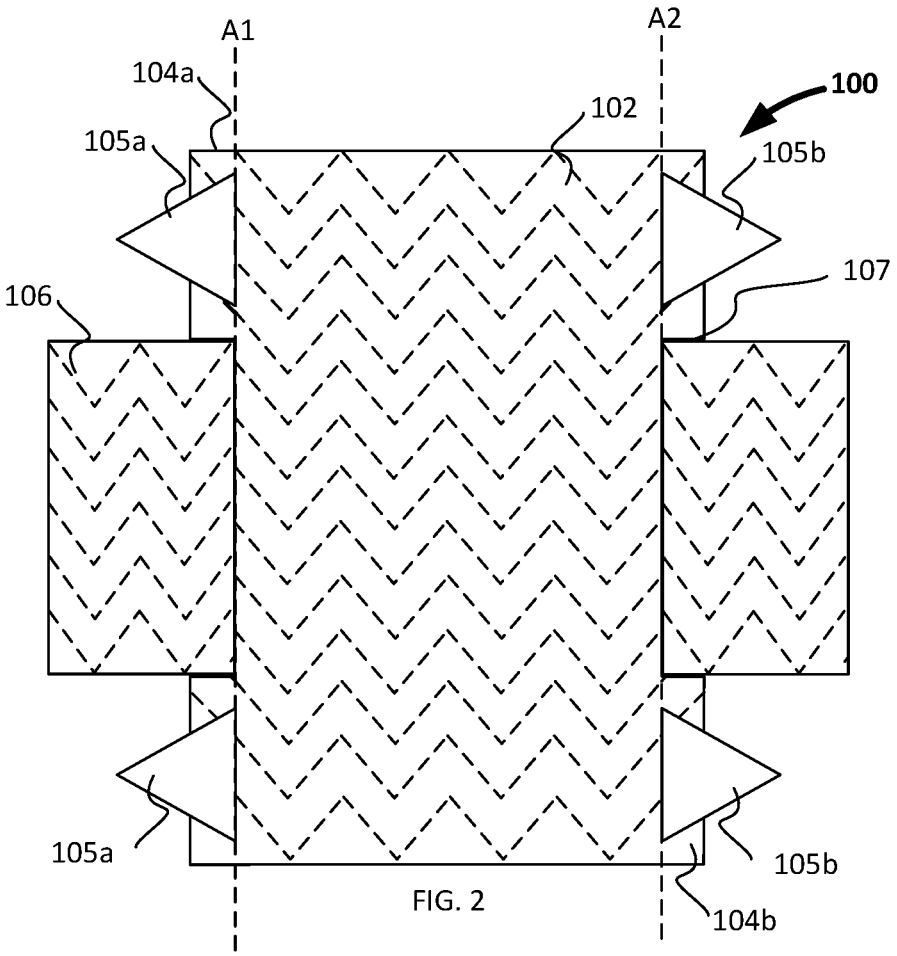

FIG. 1 illustrates one example of an item or furniture covering 100 according to the present disclosure. The components of the furniture covering 100 are shown separately, although it will be understood that they may be coupled together, for example, via sewing, glue, ultrasonic welding or other suitable techniques. Furniture covering 100 generally includes a main body 102. Main body 102 may be generally rectangular as shown, and include a pair of tabbed portions or ends 104*a* at a first end and a pair of tabbed portions or ends 104*b* at a second end. In some examples, tabbed portions 104*a*,104*b* are of a same shape and/or size. It will be understood, however, that tabbed portions 104*a*, 104*b* may be of different shapes and/or sizes. In at least some examples, main body 102 may be formed of quilted shipping blankets. A generally triangular wing 105*a*,105*b* may be sewn or otherwise coupled adjacent each of tabbed ends 104*a*,104*b*. In at least some examples, triangular wings 105*a*,105*b* may be formed of a fabric or other suitable material. In some examples, wings 105*a*,105*b* may be elastic and formed of cotton and/or LYCRA® brand of stretchable material. Additionally, a pair of end portions 106 may be sewn onto main body 102. End portions 106 may be configured and shaped in different ways to mirror the end of the object to be wrapped. In some examples, distances D1 are equal on both the end portions 106 and the tabbed ends 104*a*,104*b* as shown in FIG. 1. In at least some examples, the end portions 106 are also formed of quilted shipping blankets or other suitable materials (i.e., end portions 106 may be formed of the same material as main body 102).

Figure 5:
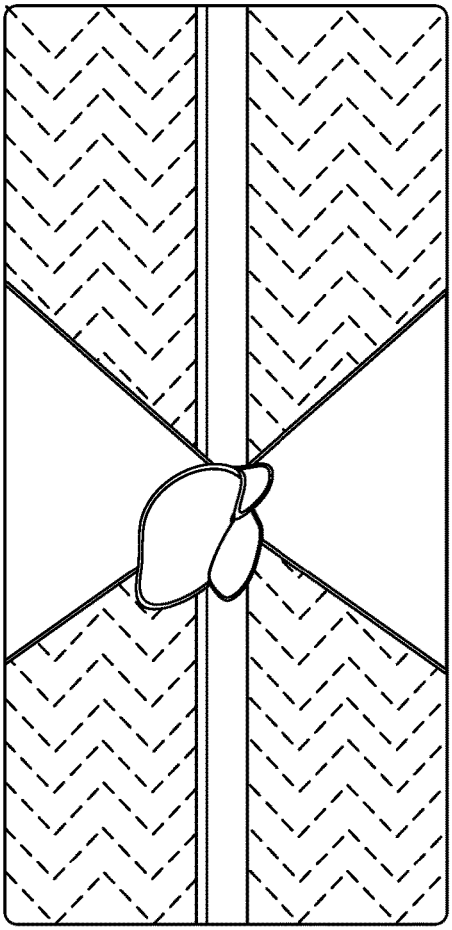
FIGS. 5-8 are photographs of some examples of the furniture covering according to the present disclosure.

FIG. 9 illustrates how the components of furniture covering 100 are sewn together. Specifically, it will be understood that end portions 106 are coupled to the midsection of main body 102 and that wings 105*a*,105*b* are sewn adjacent the two ends adjacent tabbed ends 104*a*,104*b*. In some examples, four slits 107 may be left unattached between end portions 106 and tabbed ends 104*a*,104*b*. Instead of being sewn directly on the edge of the tabbed ends, wings 105 may be set back from the edge of the tabbed ends. In some examples, wings 105*a* are aligned with the edge of the midsection of main body 102 along line A1 and wings 105*b* are aligned with an opposing edge along line A2. After placing the assembled furniture covering 100 over the item, tabbed ends may overlap one another and wings 105*a* may be tied together, and wings 105*b* may be tied together. Using this example, a box-shaped furniture covering may be formed. One example of using the furniture covering 100 to wrap a television stand is shown in FIG. 5. As shown in FIG. 5, wings 105*a* are tied together to secure the items, the wings being setback from the edge of the tabbed portion. 104*a* to disperse the forces across a larger area and more securely tie the covering 100.

Figure 3:
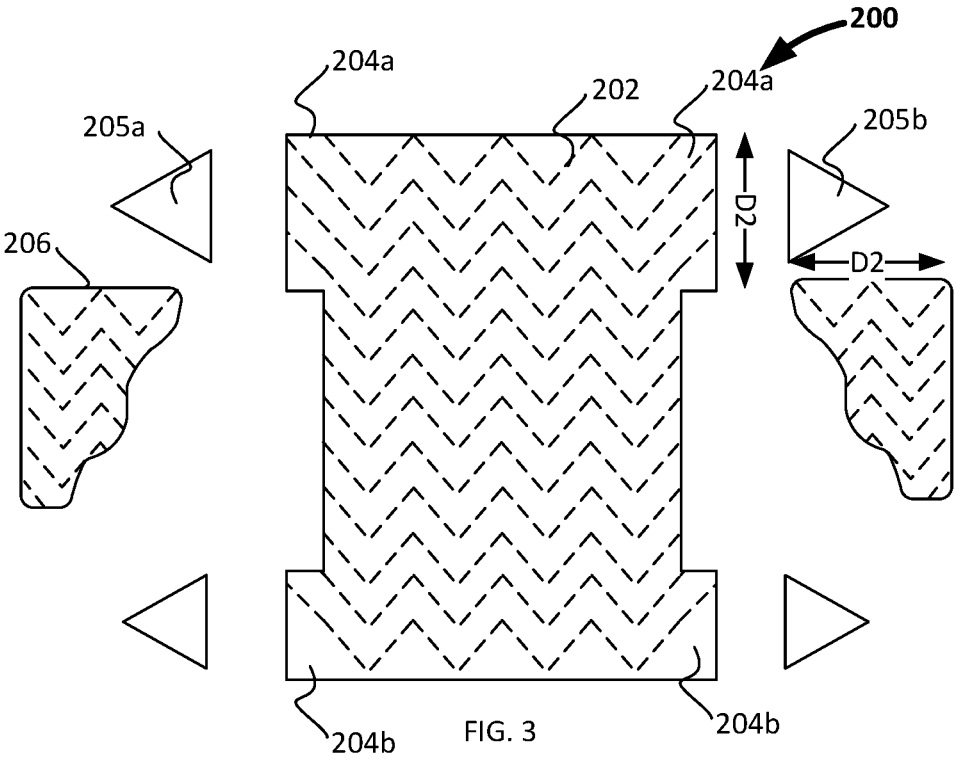
FIGS. 3-4 are schematic representations of an item covering according to a second embodiment.
Figure 4:
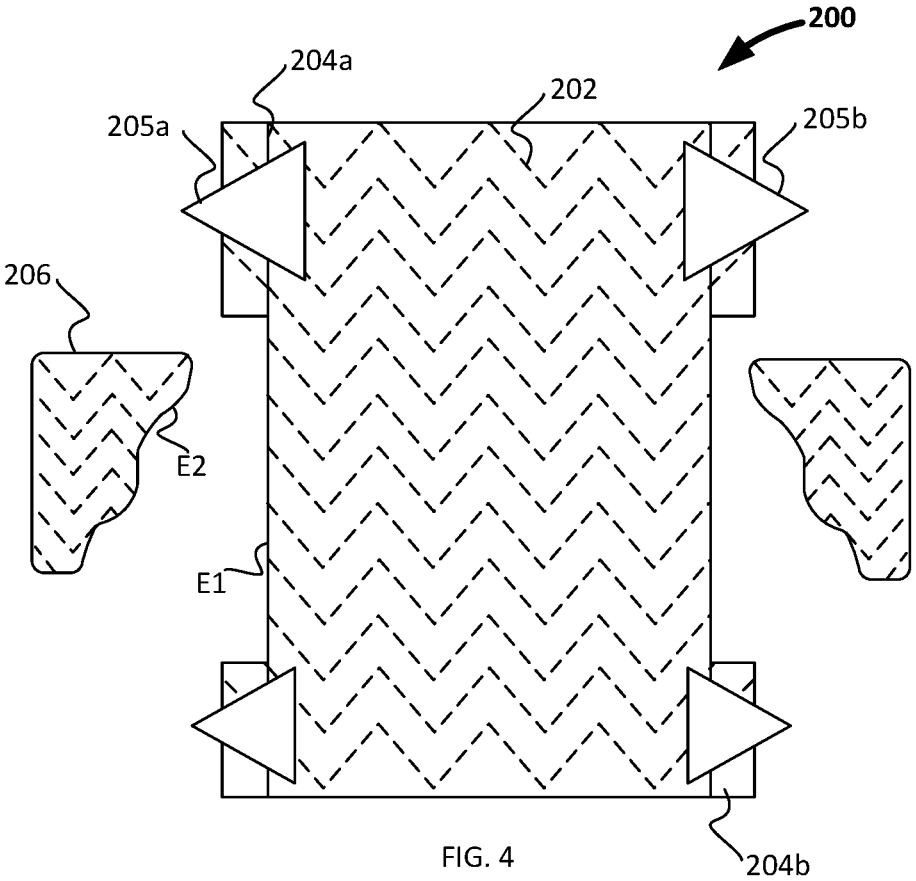

As shown in FIGS. 3-4, a furniture covering 200 may be used to wrap irregular objects. Furniture covering 200 generally includes a main body 202. Main body 202 may be generally rectangular as shown, and include a pair of tabbed portions 204*a* at a first end and a pair of tabbed portions 204*b* at a second end. In this example, tabbed portions 204*a*,204*b* are different sizes. Generally triangular wing 205*a*,205*b* may be sewn adjacent each of tabbed ends 204*a*,204*b*, A pair of end portions 206 may be sewn onto main body 102 and in this example, the end portion 206 mimics the shape of a couch as seen from the side. In some examples, distances D2 are equal on both the end portions 206 and the tabbed ends 204*a*,204*b* as shown in FIG. 1.

Figure 6:
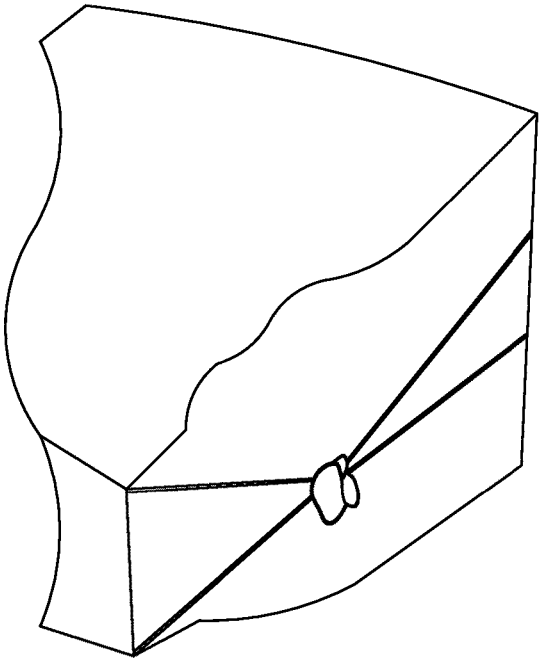
Figure 7:
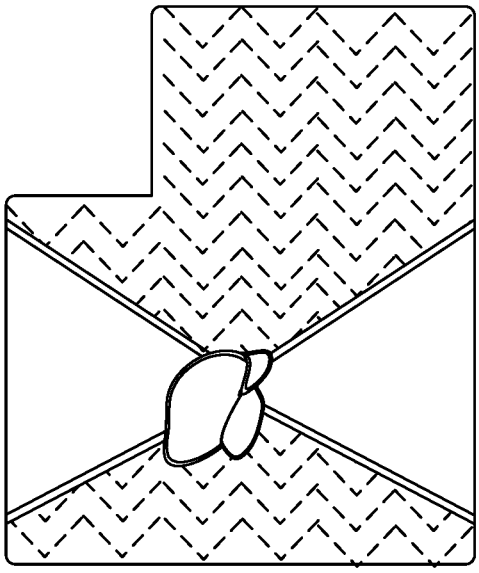
Figure 8:
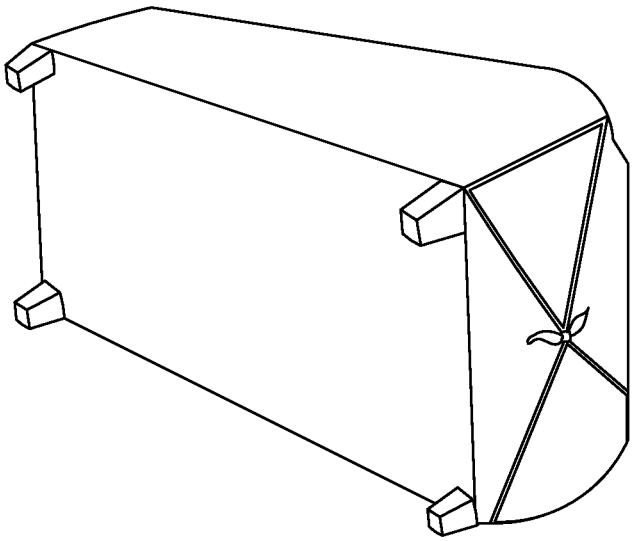

FIG. 4 illustrates how the components of furniture covering 200 are sewn together. Specifically, it will be understood that end portions 206 are coupled to the midsection of main body 202 (i.e., edge E1 of main body 202 is coupled along edge E2 of end portion 206) and that wings 205*a*,205*b* are sewn adjacent the two ends adjacent tabbed ends 104*a*, 104*i*, Instead of being sewn directly on the edge of the tabbed ends, wings 205*a,b* may be set back from the edge of the tabbed ends. In some examples, wings 205 are aligned with the edge of the midsection of main body 202 as previously discussed or disposed even closer to a midline of the main body as shown in FIG. 4. After placing the assembled furniture covering 200 over the item, tabbed ends may overlap one another and wings 205*a* may be tied together, and wings 205*b* may be tied together. One example of using the furniture covering 200 to wrap a couch is shown in FIGS. 6-8. In this example, the wings have not yet been tied together along the sides of the couch.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A furniture covering comprising:

a quilted main body extending from a first end to a second end, the quilted main body being generally I-shaped and having a first length from the first end to the second end, and a first width;

a pair of first tabbed ends disposed at the first end of the quilted main body that define a second width with the quilted main body larger than the first width, the pair of first tabbed ends being rectangular;

a pair of second tabbed ends disposed at the second end of the quilted main body that define a third width with the quilted main body larger than the first width, the pair of second tabbed ends being rectangular;

a pair of first triangular wings coupled to the first tabbed ends and set back from a respective edge thereof;

a pair of second triangular wings coupled to the second tabbed ends and set back from a respective edge thereof; and a pair of end portions coupled to a midsection of the quilted main body on opposing sides of the quilted main body.

2. The furniture covering of claim 1, wherein the pair of first wings and the pair of second wings are of a same shape.

3. The furniture covering of claim 1, wherein the pair of end portions are rectangular.

4. The furniture covering of claim 3, wherein the pair of end portions are disposed between the pair of first triangular wings and the pair of second triangular wings.

5. The furniture covering of claim 1, wherein a height of the pair of first tabbed ends the pair of second tabbed ends is equal to a width of the pair of end portions.

* * * * *